US007134747B2

(12) United States Patent
Hayashi et al.

(10) Patent No.: US 7,134,747 B2
(45) Date of Patent: Nov. 14, 2006

(54) INK CONTAINER, RECORDING HEAD AND RECORDING DEVICE USING SAME

(75) Inventors: Hiroki Hayashi, Yokohama (JP); Yasuo Kotaki, Yokohama (JP); Keisuke Matsuo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 10/667,316

(22) Filed: Sep. 23, 2003

(65) Prior Publication Data

US 2004/0114001 A1 Jun. 17, 2004

(30) Foreign Application Priority Data

Sep. 30, 2002 (JP) ..... 2002/287544
Sep. 30, 2002 (JP) ..... 2002/287551
Jan. 30, 2003 (JP) ..... 2003/021890

(51) Int. Cl.
*B41J 2/175* (2006.01)
*B41J 2/19* (2006.01)

(52) U.S. Cl. ..... 347/86; 347/49

(58) Field of Classification Search ..... 347/49, 347/86, 87
See application file for complete search history.

(56) References Cited

U.S. PATENT DOCUMENTS 5,010,354 A * 4/1991 Cowger et al. ..... 347/87
5,453,771 A 9/1995 Waseda et al. ..... 347/86
5,619,237 A 4/1997 Inoue et al. ..... 347/86
5,619,239 A 4/1997 Kotaki et al. ..... 347/86
5,703,633 A * 12/1997 Gehrer et al. ..... 347/86
5,742,310 A 4/1998 Kotaki ..... 347/86
6,102,533 A 8/2000 Nozawa et al. ..... 347/86
6,137,512 A 10/2000 Higuma et al. ..... 347/86
6,203,148 B1 3/2001 Kishida ..... 347/86
6,375,308 B1 4/2002 Shimada ..... 347/43
6,390,601 B1 5/2002 Morita et al. ..... 347/49
6,390,612 B1 5/2002 Kotaki et al. ..... 347/85
6,419,350 B1 7/2002 Abe et al. ..... 347/86
6,464,338 B1 10/2002 Morita et al. ..... 347/49
6,474,797 B1 11/2002 Kurata et al. ..... 347/85
6,623,104 B1 9/2003 Kotaki et al. ..... 347/49
6,629,758 B1 10/2003 Okamoto et al. ..... 347/85
6,742,881 B1 * 6/2004 Kotaki et al. ..... 347/86
6,776,479 B1 * 8/2004 Ardito et al. ..... 347/86
6,827,431 B1 * 12/2004 Kitabatake et al. ..... 347/86
6,863,376 B1 * 3/2005 Seino et al. ..... 347/49
2002/0118248 A1 8/2002 Inoue et al. ..... 347/37
2003/0016279 A1 1/2003 Hayashi et al. ..... 347/87

(Continued)

FOREIGN PATENT DOCUMENTS

EP 691207 1/1996

(Continued)

*Primary Examiner*—Anh T. N. Vo
(74) *Attorney, Agent, or Firm*—Fitzpatrick, Cella, Harper & Scinto

(57) ABSTRACT

An ink container includes a casing having a substantially rectangular shape; a plurality of ink accommodating portions defined by partition in the casing; ink supply ports provided, in a bottom side of the casing, for the ink accommodating portions, respectively; wherein the ink container is detachably mountable to a holder provided with a recording head portion for ejecting ink accommodated in the ink accommodating portion, wherein the plurality of ink supply ports are disposed deviated toward one of long edge of the bottom side; and a plurality of dimple portions in which the supply ports are formed, respectively, and the dimples is cut away and opens adjacent to the one of edges.

10 Claims, 12 Drawing Sheets

U.S. PATENT DOCUMENTS

| | | | | |
|---|---|---|---|---|
| 2004/0076447 | A1 | 4/2004 | Matsuo et al. | |
| 2004/0135839 | A1* | 7/2004 | Matsuo et al. | 347/19 |

FOREIGN PATENT DOCUMENTS

| | | |
|---|---|---|
| EP | 1219443 | 7/2002 |
| JP | 02-118971 | 5/1990 |
| JP | 2-118971 | 9/1990 |
| JP | 6-15839 | 1/1994 |
| JP | 8-276601 | 10/1996 |
| JP | 9-267487 | 10/1997 |
| JP | 10-100452 | 4/1998 |
| JP | 2000-6867 | 1/2000 |

* cited by examiner (a)

(b)

INK CONTAINER, RECORDING HEAD AND RECORDING DEVICE USING SAME

FIELD OF THE INVENTION AND RELATED ART

The present invention relates to an ink container to be carried on an ink jet recording head for effecting recording on a recording material by ejection of ink droplet from the ink jet recording head, more particularly to an ink container to be detachably held on an ink jet recording head of a cartridge type, and a recording head and recording device using the ink container.

A known ink jet recording apparatus comprises an ink container accommodating ink, an ink jet recording head (recording head cartridge) which receives ink from an ink container and which ejects ink droplets, a carriage for detachably carrying the ink jet recording head, feeding means for feeding a recording material such as paper, film or the like, and control means for controlling them.

The ink jet recording apparatus is easily able to provide with a function of color image recording using a plurality of color inks, and in addition, the apparatus can be downsized, and therefore, a portable color printer which can be carried with a note personal computer has been put into practice.

As an ink container for use with such a small size color printer, U.S. Pat. No. 5,619,237 for example discloses an ink container having an inside which is divided into three spaces by partitions for accommodating yellow, cyan and magenta inks, wherein ink supply ports for supplying the respective inks into the ink jet recording head are formed along the ink container inserting direction. The U.S. Patent discloses an ink container, for a small size ink jet recording apparatus, which is detachably mountable to a holder provided with an ink jet recording head structure. The ink container includes an ink supply port in a bottom surface, and a claw-like projection for engagement with a retention hole formed in an ink container holder on one end surface adjacent to the bottom surface, and an elastically supported latch lever having a latch claw for connection with an engaging hole formed in the ink container holder on the other end surface. With this structure, the ink container can be mounted to or demounted from the holder through a simple mechanism and manipulation without deteriorating the positioning accuracy. Therefore, this structure is widely used.

On the other hand, the ink container detachably mountable relative to the ink jet recording head is required to have a function of generating an appropriate degree of back pressure (negative pressure) of the ink, in order to stably retain the ink in a normal state (non-recording state) and to stably supply the ink into the ink jet head during the recording operation.

As one of ordinary methods to generate the negative pressure, porous material such as urethane foam is used to generate the negative pressure ((ink absorbing material) wherein the capillary force generated by the porous material is used. The negative pressure generating member may be in the form of a plurality of fiber absorbing materials as disclosed in U.S. Pat. No. 5,453,771, as well as the urethane foam. When the use is made with olefin resin material as the fiber absorbing material, it can be reused as a source material when the ink container is collected back after usage, and therefore, the ink container using the fiber absorbing material as the negative pressure generating member is positively employed from the standpoint of environmental problem.

Recently, the improvement in the ink jet recording head technology is remarkable, and the printing speed (power of the recording head alone) is improvement from approx. 2–5 ppm to approx. 10–20 ppm. In the case that high speed recording is carried out using the recording head capable of such high speed recording with the conventional ink container, the color recording is not appropriately performed despite the fact that sufficient amount of the ink remains in the ink container in some cases.

The inventors have investigated the causes of this problem, and has revealed that in order to accomplish such a high speed recording, the ink supply speed from the ink container to the recording head has to be raised, which requires that cross-sectional area of the ink supply port has to be increased.

In addition, particularly when the fiber absorbing material is used as the negative pressure generating member, the fibers are arranged with a desired distribution macroscopically, but the distribution state of the fibers are not uniform microscopically due to the variation in the gaps between the fibers and/or in the thickness of the fibers and/or due to the error in the manufacturing step. The flow resistance against the movement of the ink retained is different between the sparse fiber portion and dense fiber portion, and a larger amount of the ink is discharged for the sparse fiber portion where the flow resistance is low. The influence of the difference increases with the increase of the ink flow speed. When the ink supply speed is increased in an attempt to accomplish the high speed recording, the ink retained in the sparse fiber portion of the fiber absorbing material is consumed with high priority even to such an extent that before start of discharge of the ink retained in the dense fiber portion, the ink flow path is disconnected, with the result of stop of ink supply and therefore disabled printing operation.

Such a problem is newly found with further increase of the printing speed.

On the other hand, in order to raise the overall printing speed, it is desired to improve the ink accommodation efficiency/use efficiency of the ink container to reduce the exchange frequency of the ink container. However, the ink container for use with a small size color printer, particularly, an integral type color ink container containing a plurality of color inks (not more than 10 ml for each color), suffers from a small space which can be given in the recording device.

In view of this, an attempt can be made to increase the height of the ink container to improvement the ink accommodation efficiency. In this citation, however, the capillary force for retaining the ink has to be increased. This results in the fiber density in the ink absorbing material, which means a reduced ink retaining space, and therefore, the retainable amount of the ink decreases. An attempt may be made to improve the ink accommodation efficiency by using a structure with which the ink can be retained with a relatively small capillary force without increasing the height of the ink container. However, the distance from the ink retained at a position right above the ink supply port in the ink absorbing material and the ink supply port is short, and therefore, such ink exists adjacent the bottom surface of the ink container away from the ink supply port in the horizontal direction, so that such ink can be more easily discharged than the ink which is not easily influenced by the gravity. As a result, in the case of high speed recording, the ink use efficiency tends to decrease because of the large difference in the easiness of ink supply due to the difference in the distance from the ink supply port.

In the case of the ink container for use with the small size color printer, the compossibility of the improvement in the ink supply speed into the ink jet recording head, the improvement in the ink accommodation efficiency and the ink use efficiency, are difficult, because of the constraint in the size.

SUMMARY OF THE INVENTION

Accordingly, it is a principal object of the present invention to provide an integral type color ink container, a recording head using the ink container and a recording device using the same, wherein stable high speed ink supply is accomplished with a simple structure.

It is another or additional object of the present invention to provide an ink container, a first object using the ink container and a recording device using the same, which can be suitably employed with a small size recording device and which has an improved ink supply speed into the ink jet recording head, an improved ink accommodation efficiency and an improved ink use efficiency.

According to an aspect of the present invention, there is provided an ink container comprising a casing having a substantially rectangular shape; a plurality of ink accommodating portions defined by partition in said casing; ink supply ports provided, in a bottom side of said casing, for said ink accommodating portions, respectively; wherein said ink container is detachably mountable to a holder provided with a recording head portion for ejecting ink accommodated in said ink accommodating portion, wherein said plurality of ink supply ports are disposed deviated toward one of long edge of the bottom side; and a plurality of dimple portions in which said supply ports are formed, respectively, and said dimples is cut away and opens adjacent to said one of edges.

By the deviation of the positions of the ink supply ports in the bottom portion of the container toward one lateral side, the length of the ink flow path in the holder from the ink supply tube to the recording head can be shortened. As a result, even if the ink supply speed from the ink container to the recording head is increased, the large ink supply port can stabilizes the ink supply out of the ink container.

In addition, the ink supply ports are disposed in the neighborhood of the corner portion, between the bottom portion and the lateral or vertical side of the container, where the rigidity of the casing is relatively high because of the corner structure. The strength reduction of the ink container casing can be minimized. This is effective to prevent deformation of the ink container upon the container mounting to the holder and upon the connection of the liquid supply portions between the holder and the ink container.

The provision of the independent dimple portions is preferable, since when the ink container is mounted to or demounted from the holder, the ink is prevented from mixing into the other color ink supply port, and in addition, the length of the ink flow path from the ink supply tube to the recording head can be shortened. Furthermore, in addition, after ink injection into the container casing in the manufacturing, it is necessary to wipe off the ink deposited on the surface (seal surface) around the ink supply port in the dimple portion. At this time, the structure in which at least one side surface of the dimple portion is cut away and is open is advantageous since the ink can be easily wiped off. Without the cut-away portion, when the ink supply ports are disposed deviated toward one side of the container, the standing wall of the dimple portion having the ink supply port formed in the bottom thereof has only a small thickness at the side to which the ink supply ports are deviated. As a result, the ink spreads along the weld line extending from the ink supply port to the thin wall portion and will contaminate users fingers and hands. However, according to the present invention, the standing wall of the dimple portion is open at one lateral side of the ink container, that is, there is provided a cut-away portion, so that there is no thin portion, and therefore, there appears no weld line. In this manner, a highly reliable ink container can be accomplished.

According to a further aspect of the present invention, there is provided an ink container further comprising mounting engageable members at respective positions such as to interpose said plurality of supply ports therebetween, wherein as seen from a top of said ink container, a phantom straight line connecting centers of said mounting engageable members crosses with all of said plurality of supply ports.

With this feature, the container is prevented from twisting upon the mounting of the container to the holder, so that container can be stably secured with the holder by a small number of engageable portions. By the provision of the engaging portion at the position close to the side wall, the ink container positioning mechanism can be disposed at a position where the container strength is high, so that stabilized mounting can be accomplished with all the ink supply ports and the ink receiving tubes securedly connected respectively.

According to a further aspect of the present invention, there is provided an ink container, wherein one of said mounting engageable members includes an engaging claw provided on a side surface of said casing, and the other is an engaging claw provided on a lever extending from said casing, and wherein such one of ink supply ports as is closest to said engaging claw provided on said side surface of said casing is deviated toward said partition.

With this feature, the volume of the ink accommodating portion can be assured so that second object of the present invention is also accomplished.

According to a further aspect of the present invention, there is provided an ink container, wherein each of said ink accommodating portion includes an air vent for fluid communication between inside of said ink accommodating portions and an ambience, a first liquid retaining member in the form of a sheet which extends on an inner bottom surface of said casing substantially along an inner configuration of the bottom surface and which is capable of being abutted by an external member through said ink supply port; a second liquid retaining member closely contacted to said first liquid retaining member to supply the ink therefrom to said first liquid retaining member, wherein said first liquid retaining member has a liquid retaining force which is larger than that of said second liquid retaining member.

With this structure, since the liquid retaining force of the first liquid retaining member is larger than that of the second liquid retaining member, the liquid in the liquid container tends to be retained more in the neighborhood of an external member to which the liquid is to be supplied, and therefore, the liquid in the liquid container is stabilized. In addition, by the first liquid retaining member extending substantially along the inner surface configuration of the portion having the liquid supply opening of the casing, the variation of the liquid flow within the second liquid retaining member, that is, the variation in the flow resistance in the second liquid retaining member (variation in the fiber density and the like) is less influential, so that liquid can be supplied stably even if the flow rate is large. Therefore, a stable ink supply is accomplished in a thin and flat type liquid container. In addition, since the liquid retaining force of the first liquid retaining member is larger than that of the second liquid retaining member, the amount of the remaining liquid after the liquid discharge is larger in the first liquid retaining member than in the second liquid retaining member. Particularly, in the case of the high speed liquid supply, the influence is relatively larger. When the first liquid retaining member is in the form of a thin sheet, the above-described effect can be provided, and the inside volume of the first liquid retaining member is decreased, thus decreasing the remaining amount of the liquid. With such a structure, a wasteful space can be eliminated in an ink container having a rectangular parallelopiped configuration, thus increasing the ink accommodation space, and permitting a consumption of the ink without waste even in the case of high speed recording. Thus, the present invention can provide an ink container, a first object using the ink container and-a recording device using the same, which can be suitably employed with a small size recording device and which has an improved ink supply speed into the ink jet recording head, an improved ink accommodation efficiency and an improved ink use efficiency.

According to a further aspect of the present invention, there is provided a ink jet recording head comprising a holder for detachably holding an ink container as described above and a recording head portion for receiving the ink from said ink container held in said holder and for ejecting ink droplets, and a ink jet recording apparatus comprising a carriage for detachably carrying such an ink jet recording head, wherein the ink droplets are ejected from said ink jet recording head onto a recording material to effect recording on the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Referring to the accompanying drawings, the preferred embodiments will be described.

Figure 1:
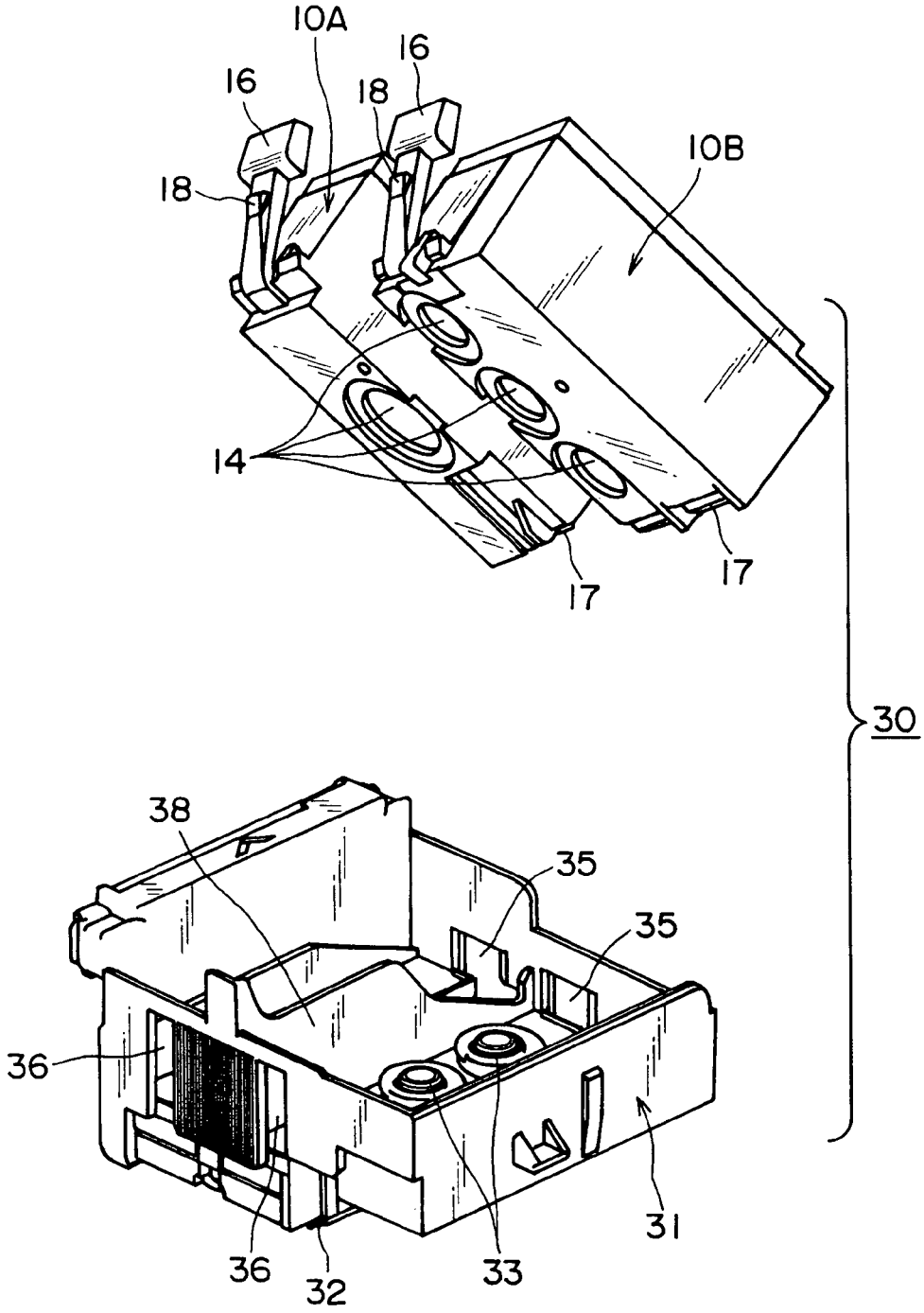
FIG. 1 is a perspective view of an outer appearance of an ink container and a holder portion which constitute color recording head cartridge according to an embodiment of the present invention.
Figure 2:
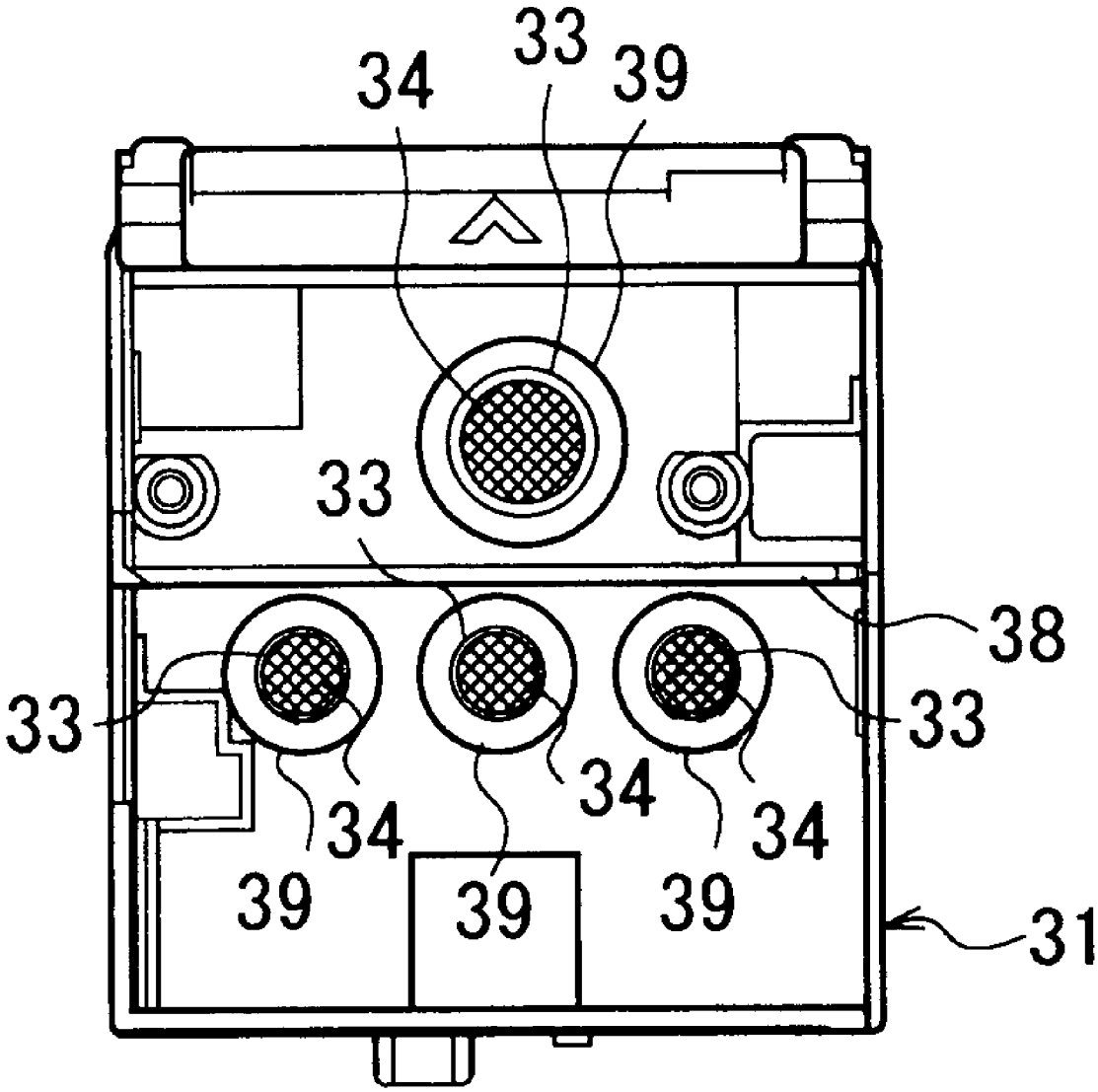
FIG. 2 is a top plan view of a holder shown in FIG. 1.
Figure 3:
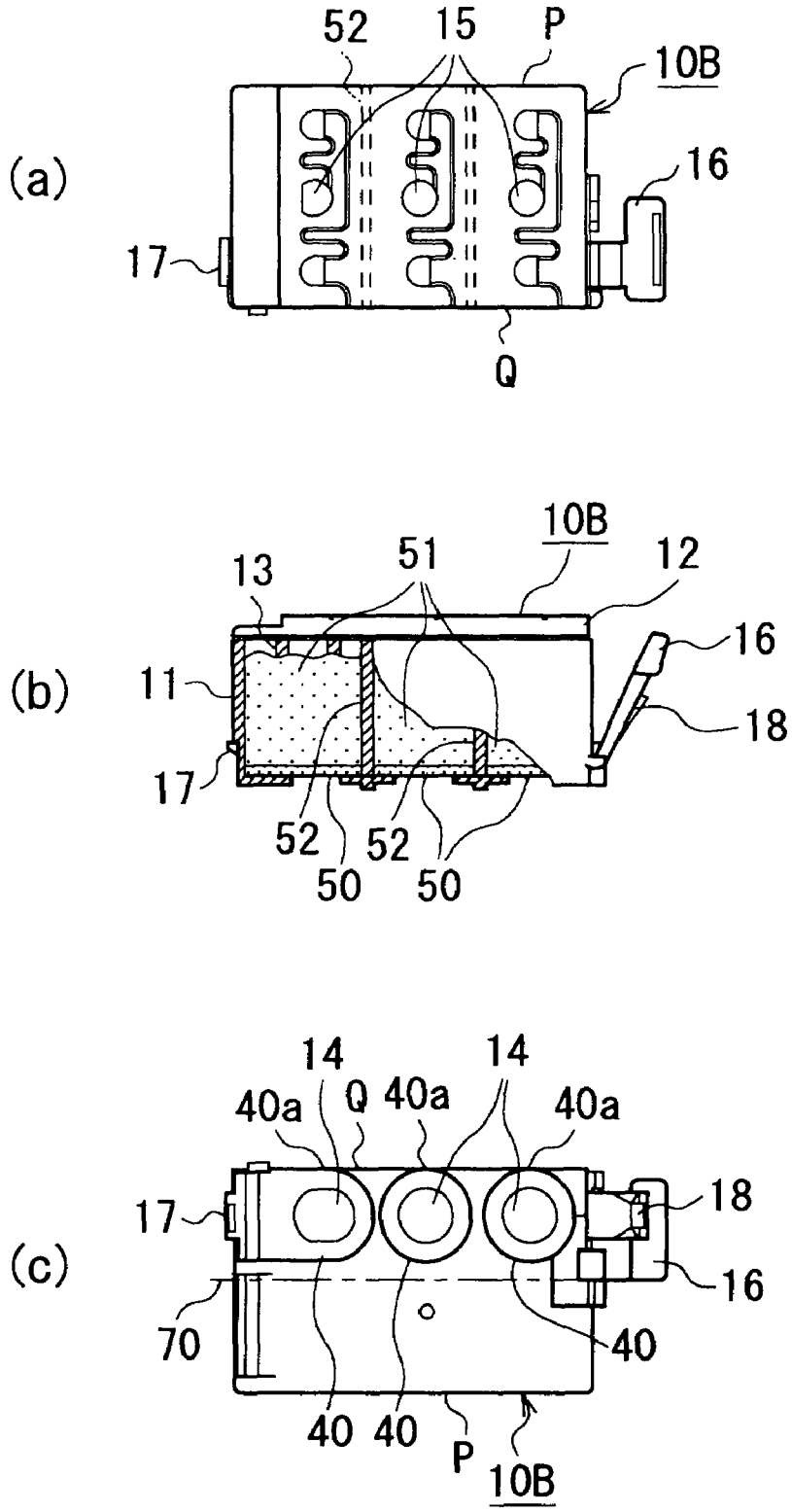
FIG. 3 illustrates a structure of the ink container shown in FIG. 1, wherein (a) is a top plan view, (b) is a partly broken side view, and (c) is a bottom view.
Figure 4:
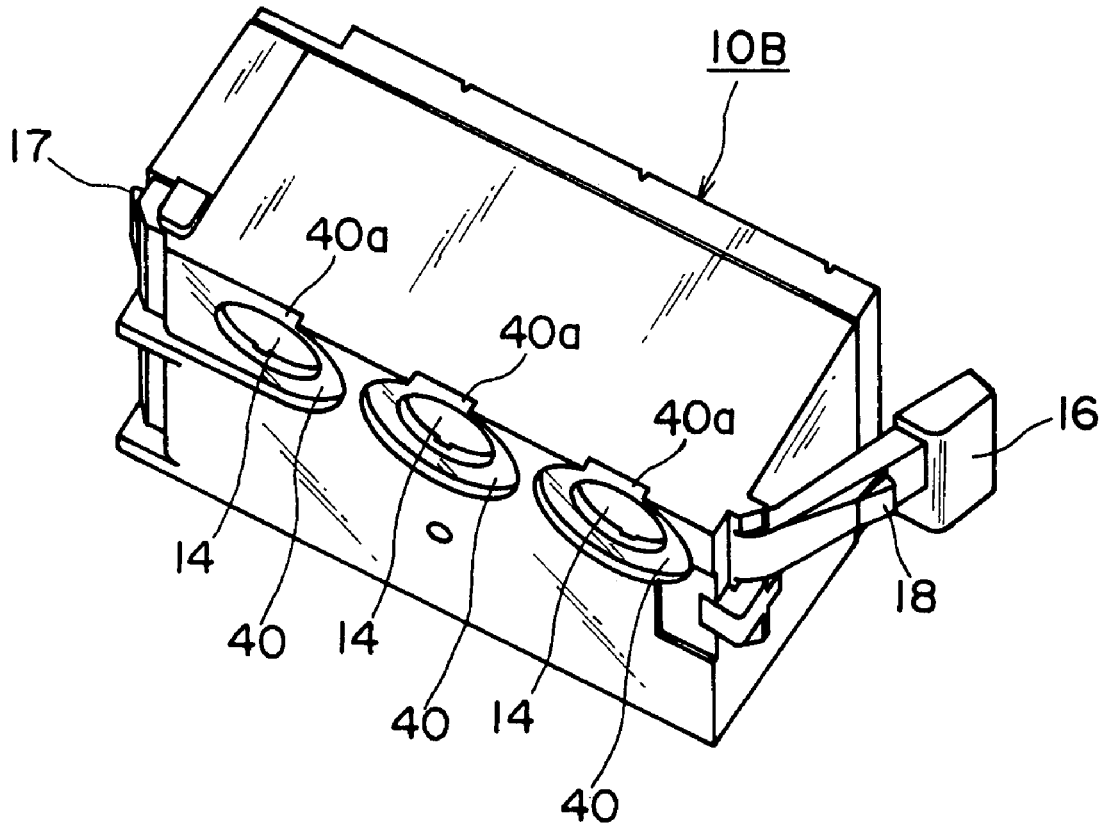
FIG. 4 is a perspective view of a color ink container shown in FIG. 1.
Figure 5:
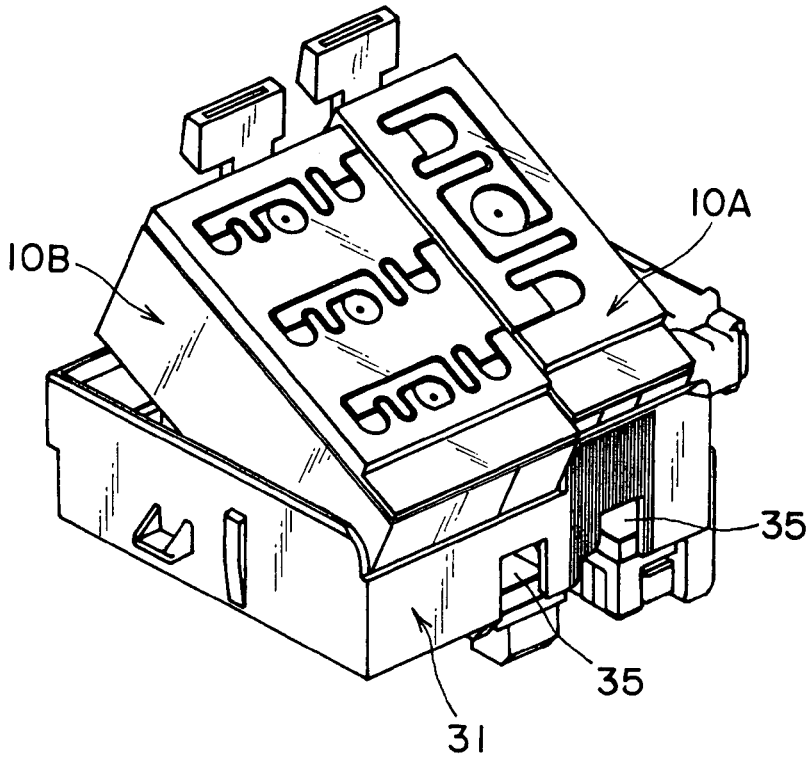
FIG. 5 is a perspective view illustrating a state in which a black ink container and a color ink container are going to be mounted into the holder shown in FIG. 1.
Figure 5:
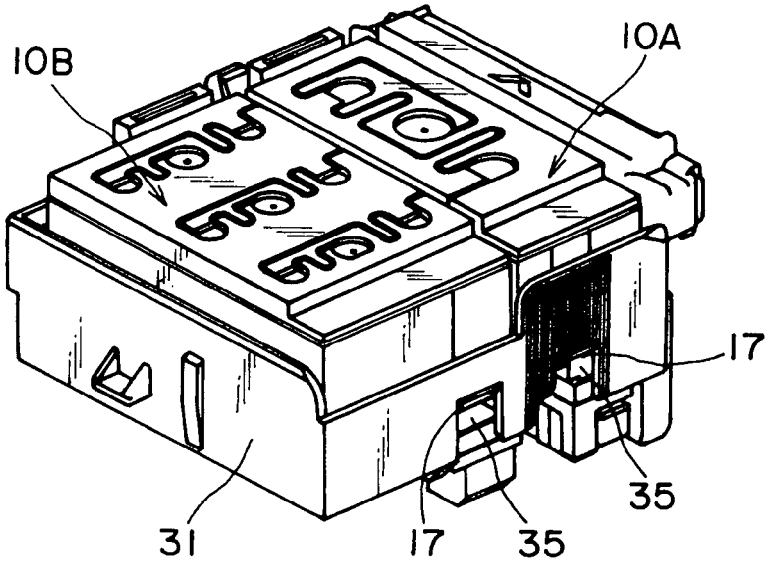
Figure 6:
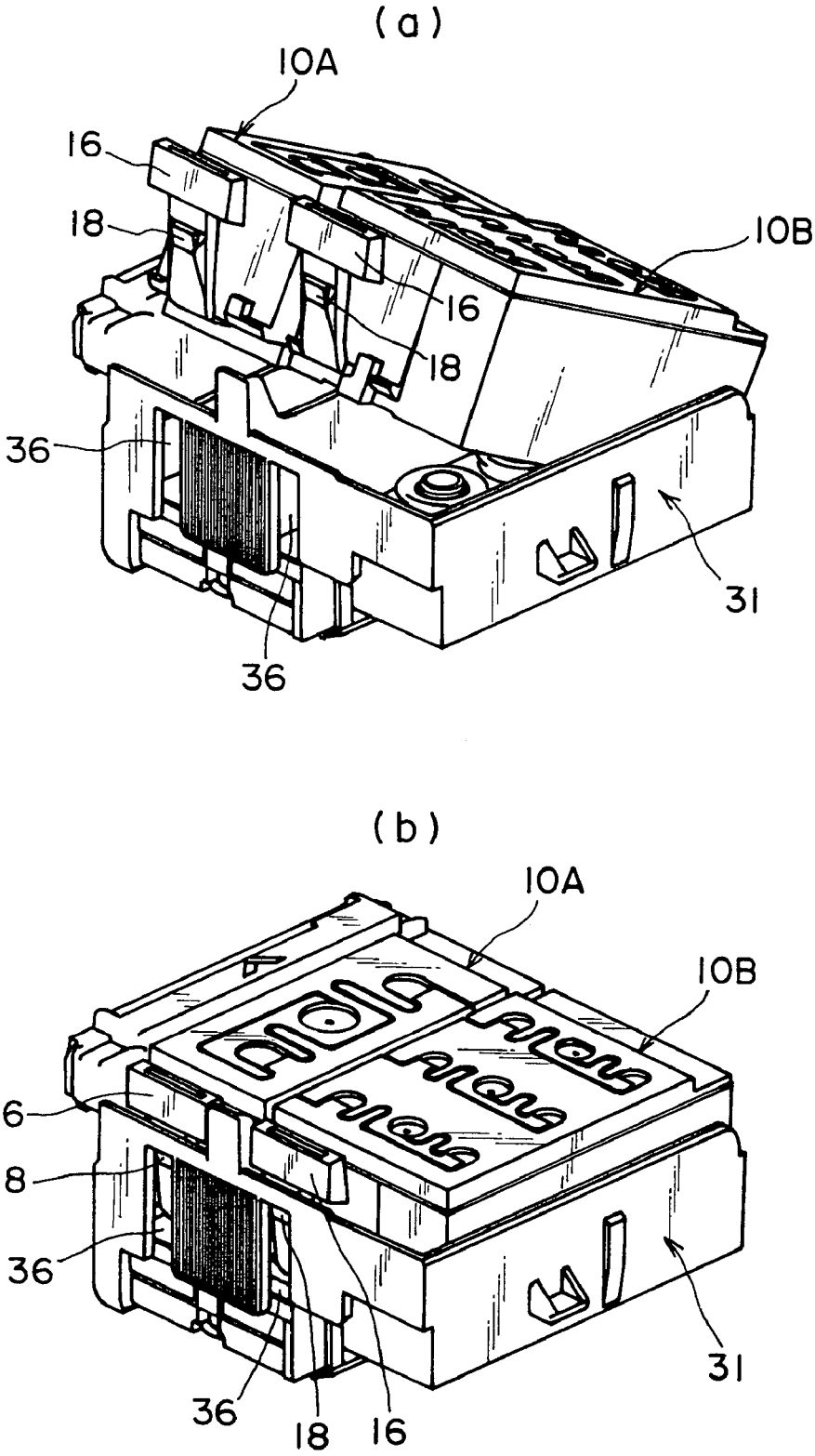
FIG. 6 is a perspective view illustrating a state in which a black ink container and a color ink container are going to be mounted into the holder shown in FIG. 1.

FIG. 1 is a perspective view of an outer appearance of an ink container and a holder portion which constitute color recording head cartridge according to an embodiment of the present invention. FIG. 2 is a top plan view of a holder shown in FIG. 1. FIG. 3 illustrates a structure of the ink container shown in FIG. 1, wherein (a) is a top plan view, (b) is a partly broken side view, and (c) is a bottom view. FIG. 4 is a perspective view of a color ink container shown in FIG. 1. FIG. 5 is a perspective view illustrating a state in which a black ink container and a color ink container are going to be mounted into the holder shown in FIG. 1. FIG. 6 is a perspective view illustrating a state in which a black ink container and a color ink container are going to be mounted into the holder shown in FIG. 1.

As shown in FIG. 1, the recording head cartridge 30 for color recording comprises a holder 31 which has an integral recording head portion 32 (ink jet type) for ejecting ink droplets, an ink container 10A detachably held by the holder 31, and an ink container 10B. The ink container 10A contains black ink to be supply to the recording head portion 32. The ink container 10B contains yellow, magenta and cyan-inks to be supplied to the recording head portion 32, respectively.

The head portion 32 is disposed at a bottom portion of the holder 31 in use, and comprises a group of ejection outlet (unshown) corresponding to the black ink to be supplied from the ink container 10A, a group of ejection outlets (unshown) for the yellow ink to be supplied from the ink container 10B, a group of ejection outlets (unshown) for the magenta ink, and a group of ejection outlets (unshown) for the cyan ink. At the connecting portion of the holder 31 between the ink containers 10A, 10B, there are provided projected ink receiving tubes 33 corresponding to the respective color inks accommodated in the ink containers 10A, 10B, and the ink receiving tubes 33 are in fluid communication with the respective groups of the ejection outlets through the respective ink supply passages (unshown). In order to define the regions for receiving the respective ink containers 10A, 10B, the bottom wall of the holder 31 is provided with integral partition plates 38.

The holder 31 is provided with one ink receiving tube 33 corresponding to the position of the ink supply port 14 of the ink container 10A for the black color and is provided with three ink receiving tubes 33 corresponding to the position of the ink supply ports 14 of the color ink containers 10B. Around each of the ink receiving tubes 33, a sealing member 39 is mounted to prevent ink evaporation and ink leakage, into the holder 31, of the ink supplied from the ink containers 10A, 10B through the ink receiving tube 33.

On the other hand, the ink container 10B comprises a casing 11 which constitutes an ink accommodating portion for accommodating thing and which has an open top end, and a cap member 12 which closes the top end of the casing 11 and which is provided with a rib structure 13 for providing a buffering space.

The bottom portion of the casing 11 is provided with ink supply ports 14 at positions corresponding to the ink receiving tubes 33, for the respective colors, of the holder 31 when the ink container 10B is mounted to the holder 31.

Within the casing 11, there are provided a first ink retaining member 50 and a second ink retaining member 51 for being impregnated with the respective inks to retain them. The first ink retaining member 50 is closely contacted to the second ink retaining member 51 between the second ink retaining member 51 and the ink container bottom wall and closes the ink supply port 14.

The basic structure of the ink container applies also to the ink container 10A for the black color.

However, in the case of the ink container 10B for the color inks, the inside of the casing 11 has to accommodate three color inks, and therefore, as shown in FIG. 3, two parallel partition plates 52 divide the inner space into three substantially equal ink containing spaces in the manner that long side of the bottom surface which is substantially rectangular-shaped is divided. By the provision of the partition plates so as to divide the long side of the bottom surface of the ink container having the rectangular parallelopiped configuration, the size of the ink supply port 14 formed in the bottom surface can be made larger than in the case that inside space is divided by partitions extending along the short side of the bottom surface, as will be understood from (c) in FIG. 3. More particularly, referring to FIG. 3, (c), the bottom surface of the ink container has a rectangular configuration of approx. 25 mm×approx. 40 mm, the supply openings have diameters 6 mm, 6 mm and 7 mm in this order from the right side of this Figure and are approx. 1–5 mm away from the partition walls and side wall of the casing. These three spaces are arranged substantially on a line connecting a retention claw 17 and a latch claw 18 which are engaging portions when the color ink container 10B is mounted to the holder 31. The opening area of the supply port that is closest to the retention claw 17 is larger than the opening areas of the other supply ports, and therefore, when the ink container is mounted to and demounted from the holder (FIGS. 5 and 6), which will be described hereinafter, the damage of the filter 34 can be prevented, and by making the configuration of the ink container casing substantially rectangular parallelopiped, the ink accommodation efficiency of the ink container can be improved. Only the supply ports are deviated toward the partition wall, and therefore, when the ink container is mounted to and demounted from the holder, which will be described hereinafter, the damage of the filter 34 can be prevented. Also by making the configuration of the ink container casing substantially rectangular parallelopiped configuration, the ink accommodation efficiency of the ink container can be improved.

The bottom surface of the casing 11 is provided with yellow, magenta and cyan ink supply ports 14 corresponding to the respective containing spaces in the casing 11, in this order from the right side of FIG. 3. The ink supply ports 14 are disposed deviated toward one of the long edges of the bottom surface, that is, toward one of the vertical lateral walls. By this deviated or offset arrangement of the supply ports, the ink receiving tubes 33, on the respective colors, of the container holder can be arranged consecrated as shown in FIG. 2. For this reason, the length of the ink supply passages (unshown) connecting the ink receiving tubes and the ejection outlet portions of the recording head can be shortened, by which the ink flow resistances can be reduced, which is desirable particularly in the case of high-speed recording operation.

Around the ink supply port 14, there is provided a dimple portion 40 which is formed by reducing the thickness of the bottom wall of the casing 11. The bottom surface of the dimple portion 40 functions as a seal surface to which a sealing member 39 provided around the ink receiving tube 33 of the holder 31 is sealingly contacted. A standing wall of the dimple portion 40 is cut away at least at one side Q of the ink container 10B and is opened (cut-away portion indicated by reference numeral 40*a* in FIG. 4). The provision of the independent dimple portions is preferable, since when the ink container is mounted to or demounted from the holder, the ink is prevented from mixing into the other color ink supply port. Since in this embodiment, the dimple portion is cut away at one side Q, the ink supply ports can be made closer to the side wall. This is preferable from the standpoint of mechanical strength of the ink container and shortening of the unshown ink supply passage in the holder, as will be described hereinafter.

Each of the ink containing spaces of the has a first ink retaining member 50 for absorbing and retaining the yellow, magenta, cyan ink, and has a second ink retaining member 51 for supplying the ink out.

The first ink retaining member 50 and the second ink retaining member 51 both function to be impregnated with and to retain the ink, but is different in the ink retaining force, more particularly, the ink retaining force of the first ink retaining member 50 (capillary force) is higher than the ink retaining force of the second ink retaining member 51. By doing so, the ink retained in the second ink retaining member 51 is effectively introduced into the first ink retaining member 50, so that usability of the ink retained in the second ink retaining member 51 is improved.

In this embodiment, the ink retaining members 50, 51 comprises a laminated webs in which fibers of polyolefin thermoplastic resin material are oriented substantially unidirectionally, and the fibers are compressed in the direction of lamination (fiber aggregate).

In the ink container of this embodiment, the casing 11 and the cap member are made of a material which is similar to the material of the first ink retaining member 50 and the second ink retaining member 51, that is, a polyolefin resin material. Therefore, the recycling property and the reuse property are significantly improved, which is preferable from the standpoint of environmental health.

When the ink container 10B is mounted into the holder 31, the ink receiving tube 33 is abutted to the first ink retaining member 50 in the ink supply port 14, and the ink retained in the second ink retaining member 51 is directed to the ink supply port 14 by way of the first ink retaining member 50, and is supplied to the group of ejection outlets for each color from the recording head portion 32 through the ink receiving tube 33 and the ink supply passage extending to the recording head portion 32. At this time, the sealing member 39 provided around the ink supply port 14 is sealingly contacted to the bottom surface (seal surface) of the dimple portion 40 having the ink supply port 14, so that possible ink leakage and the ink evaporation can be suppressed. A free end each of the ink receiving tubes 33 is provided with a filter 34 to prevent invasion of foreign matter into the ink receiving tube.

The ink containers 10A, 10B is provided with an ordinary latch lever mechanism for securing with the holder. In this embodiment, the latch claw 18 which is one of engaging portions between the ink containers 10A, 10B and the holder 31, is provided on a latch lever 16 which upwardly extends inclined and/or curved from a portion of a side surface of the ink container adjacent the bottom portion of the ink container. The latch lever 16 elastically deforms such that latch claw 18 is engaged with the latch claw engaging hole 36 of the holder 31. The latch lever 16 has an operating portion (tag portion at the topmost portion of the latch lever) which facilitates at least a demounting manipulation of the ink container from the holder 31. In addition, the latch lever 16 elastically displaces toward the main body of the ink container when the ink container is mounted to the holder 31, More particularly, when the ink container 10A, 10B is mounted, the ink container 10A, 10B, as shown in FIG. 5, is first inserted inclinedly adjacent the portion having the retention claw 17 toward the portion container mount position of the holder 31, such that retention claw 17 is brought into engagement with the retention claw engaging hole 35 of the holder 31. Then, the ink container 10A, 10B is pressed down so as to rotate it about the retention claw 17 side, by which the latch lever 16 is elastically displaced toward the main body the ink container, and the latch claw 18 of the latch lever 16 is brought into engagement with the latch claw engaging hole 36 of the holder 31, as shown in FIG. 6.

By mounting the ink container 10A, 10B into the holder 31, the inks in the ink containers 10A, 10B are supplied through the ink receiving tubes 33 and ink supply passages in the holder 31 corresponding to the respective colors to the groups of the ink ejection outlets of the recording head portions 32, respectively.

When the ink container 10A, 10B is to be removed from the holder 31, the operating portion of the latch lever 16 is elastically deformed toward the main body of the ink container, and the ink container 10A, 10B is taken out of the holder 31.

The casing of the ink container according to the present invention will be described further.

As will be understood from FIG. 3, (c), in a color ink container 10B having a plurality of ink supply ports 14, the ink supply ports 14 for the respective colors, retention claws 17 and latch claws 18 are linearly arranged deviated in a direction substantially perpendicular to the direction of a line connecting the latch claw 18 and the retention claw 17 toward one side surface Q of the two side surfaces P, Q sandwiching the bottom portion of the ink container 10B. In other words, the ink supply ports 14, retention claw 17 and the latch claw 18 are all arranged substantially on a line deviated, toward one side surface Q, away from a center line of the ink container extending in the direction connecting the latch claw 18 and the retention claw 17. The ink supply port 14 are formed in a bottom surfaces of the dimple portion 40, and the standing wall portion of the dimple portion 40 is cut away at least at a side surface Q side of the ink container 10B (cut-away portion designated by reference numeral 40*a* in FIG. 4).

With such a structure, the portion of the container bottom wall where the ink supply ports 14 are formed and therefore the strength of the casing is likely to be relatively weak, acquires high strength by positioning such a portion adjacent the corner portion (side wall connecting with the container bottom wall) where the rigid is relatively high. Additionally, since the two engaging portions where the ink container 10B and the holder 31 are engaged (retention claw 17 and latch claw 18) are deviated toward the side wall of the container similarly to the ink supply ports 14, the container is prevented from twisting upon the mounting of the container to the holder, so that container can be stably secured with the holder by a small number of engageable portions. Particularly, even when the number of ink supply ports is large, the twisting of the ink container can be minimized effectively by the linear arrangement of the engageable portions and the ink supply ports.

By the provision of the engaging portion at the position close to the side wall, the ink container positioning mechanism can be disposed at a position where the container strength is high, so that stabilized mounting can be accomplished with all the ink supply ports 14 and the ink receiving tubes 33 securedly connected respectively. These advantages are particularly significant when the wall thickness of the entire ink container casing is reduced in order to assure a large inside volume without increasing the sides occupied by the ink container.

In addition, after ink injection into the container casing in the manufacturing, it is necessary to wipe off the ink deposited on the surface (seal surface) around the ink supply port 14 in the dimple portion 40. In such a case, the structure in which at least one side surface Q of the dimple portion 40 is cut away and is open (cut-away portion 40*a* in FIG. 4) is advantageous since the ink can be easily wiped off.

Generally, when the ink supply ports are disposed deviated toward one side of the container, the standing wall of the dimple portion having the ink supply port formed in the bottom thereof has only a small thickness at the side to which the ink supply ports are deviated. At the thin wall molding portion, a weld line tends to appear. As a result, the ink spreads along the weld line extending from the ink supply port to the thin wall portion and will contaminate users fingers and hands. However, according to the present invention, the standing wall of the dimple portion is open at one lateral side of the ink container, that is, there is provided a cut-away portion 40*a*, so that there is no thin portion, and therefore, there appears no weld line. In this manner, a highly reliable ink container can be accomplished.

In this specification, "the engaging portions and the ink supply ports are arranged substantially linearly" means not only the structure in which the centers of the openings of the ink supply ports 14 are on the center line connecting the retention claw 17 and the latch claw 18 but also the structure in which the ink supply ports 14 are overlaid on the center line.

According to the embodiment, a hole for container fixing in the holder 31 may be formed at the of only two portions, namely, retention claw engaging hole 35 and latch claw engaging hole 36. For this reason, it is not necessary to form a large hole in the holder 31, by which the deterioration of the holder strength can be avoided.

According to this embodiment, the inside of the container is divided by partition walls 52 which extend in the direction perpendicular to the direction in which the retention claw 17 and the latch claw 18 (the engaging portions for mounting the color ink container 10B to the holder 31) are arranged. This structure is defective to enhance the mechanical strength of the wall in which the ink supply ports are formed. Such a structure is preferable because the rigidity of the container in the direction in which the ink container tends to be twisted when the ink container is mounted to the holder 31.

In this embodiment, the ink mounting mechanism relative to the holder uses a latch lever. However, the present invention is not limited to the structure using the mounting mechanism employing a latch lever. For example, a lever mechanism may be provided in the holder, or another mechanism is usable, if the ink container can be effectively secured in the holder at the front and rear thereof with respect to the direction in which the ink supply ports are arranged.

In the foregoing embodiment, the ink container comprises an ink absorbing material of fiber material. However, this is not limiting to the present invention, namely, another ink absorbing material is usable, or the ink container may not have an ink absorbing material.

The description will be made as to an inside structure of the ink container (liquid container) which is suitable to the present invention. When the internal structure is applied to the ink container 10B of the present invention, the supply speed from the ink container to the recording head is improved synergetically, particularly in the case that ink container is used for a color ink container for a small size color printer.

In the following descriptions, only one ink accommodating portion is taken for the simplicity of explanation. The drawings are schematic for easy understanding of the invention, and the scale is not always uniform.

(First Embodiment)

Figure 8:
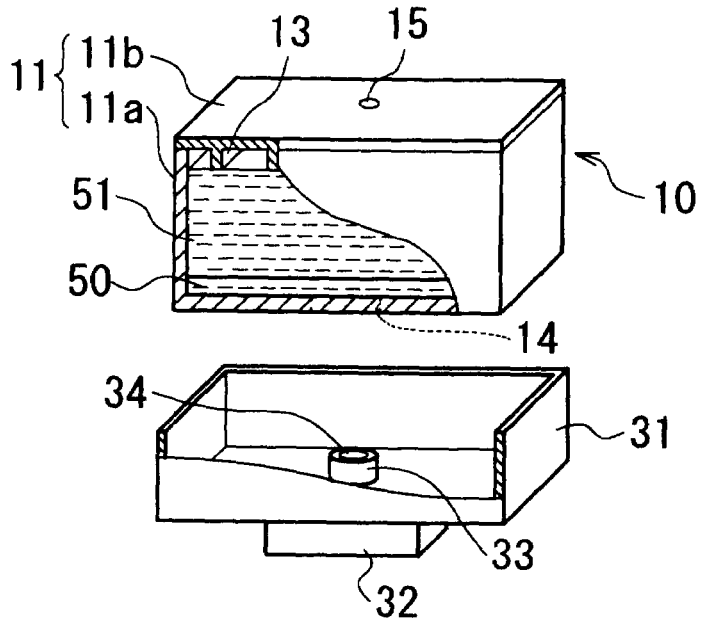
FIG. 8 is a partly broken perspective view of the ink container, the ink jet head and the holder before connection.

First example will be described referring to the drawings. FIG. 8 illustrates an ink jet cartridge 130 comprising an ink container 110 (liquid container) and a holder 131 to which the ink container 110 is mountable. FIG. 8 is a partly broken perspective view, in which the holder 131 and the ink container 110 are separated for better understanding.

As shown in FIG. 8, the ink jet cartridge 130 includes a holder 131 having an-integral ink jet head 132 for ejecting the ink, and an ink container 110 detachably mountable to the holder 131. The ink container 110 accommodates the ink which is liquid to be supplied to the ink jet head 132.

The ink jet head 132, in use, is disposed on the bottom portion of the holder 131 and is provided with a group (unshown) of ejection outlets through which the ink supplied from the ink container 110 is ejected out. At the connecting portion between the holder 131 and the ink container 110, an ink receiving tube (outer member) 133 is projected, and the ink receiving tube 133 is in fluid communication with the group of the ejection outlets through the ink supply passages (unshown). The free end of the ink receiving tube 133 is provided with a filter 134 for preventing invasion of foreign matter into the ink receiving tube 133. When the ink container 110 is mounted to the holder 131, the ink is supplied to the group of the ejection outlets by way of the ink receiving tube 133 and the ink supply passage from the ink container 110.

The ink container 110 comprises a casing 111 constituting the ink accommodating portion, and the casing 111 a main body 111*a* which is open at the top, and a cap member 111*b* for closing the opening of the main body 111*a*. The cap member 111*b* has an air vent 115 and a rib structure 113 for forming a buffer space. As shown in FIG. 3, the bottom portion of the main body 111*a* of the casing 111 is provided with an ink supply port 114 at a position facing to the ink receiving tube 133 of the holder 131 when the ink container 110 is mounted to the holder 131. Around the ink receiving tube 133, there is provided an o-ring (unshown) to prevent leakage, into the holder 131, of the ink supplied through the ink receiving tube 133 from the ink container 110 and to prevent evaporation of the ink.

Within the casing 11, there are provided a first ink retaining member 50 and a second ink retaining member 51 for being impregnated with the respective inks to retain them. The first ink retaining member 150 is disposed between the second ink retaining member 151 and the bottom surface of the ink container 110 and is closely contacted to the second ink retaining member 151 so as to plug the ink supply port 114 at the inside. The first ink retaining member 150 follow substantially the inner surface configuration of the portion (bottom surface) where the ink supply port 114 is provided.

The first ink retaining member 150 and the second ink retaining member 151 both function to absorb and retain the ink, but the ink retaining force (capillary force) of the first ink retaining member 150 is larger than that of the second ink retaining member 151. Accordingly, the ink retained in the second ink retaining member 151 is efficiently supplied to the first ink retaining member 150 with the result that usability of the ink retained in the second ink retaining member 151 is improved. In this embodiment, the ink retaining members 150, 151 comprises a laminated webs in which fibers of polyolefin thermoplastic resin material are oriented substantially unidirectionally, and the fibers are compressed in the direction of lamination (fiber aggregate). The first ink retaining member 150 is made of fibers with a fineness of 6.7 dtex (diameter: approx. 54 μm), and the density after compression is approx. 0.08 g/cm$^3$. The first ink retaining member 150 is made of fibers with a fineness of 2.2 dtex (diameter: approx. 18 μm), and the density after compression is approx. 0.20 g/cm$^3$.

The first ink retaining member 150 and the second ink retaining member 151 are rectangular in configuration of 14 mm×38 mm in a cross-section along an abutting direction of the ink receiving tube 133, and a thickness of the first ink retaining member 150 measured in a direction An of abutment to the ink receiving tube 133 is 1.5 mm, and that of the second ink retaining member is 12.5 mm. Therefore, the first ink retaining member 150 is in the form of a thin sheet.

Figure 9:
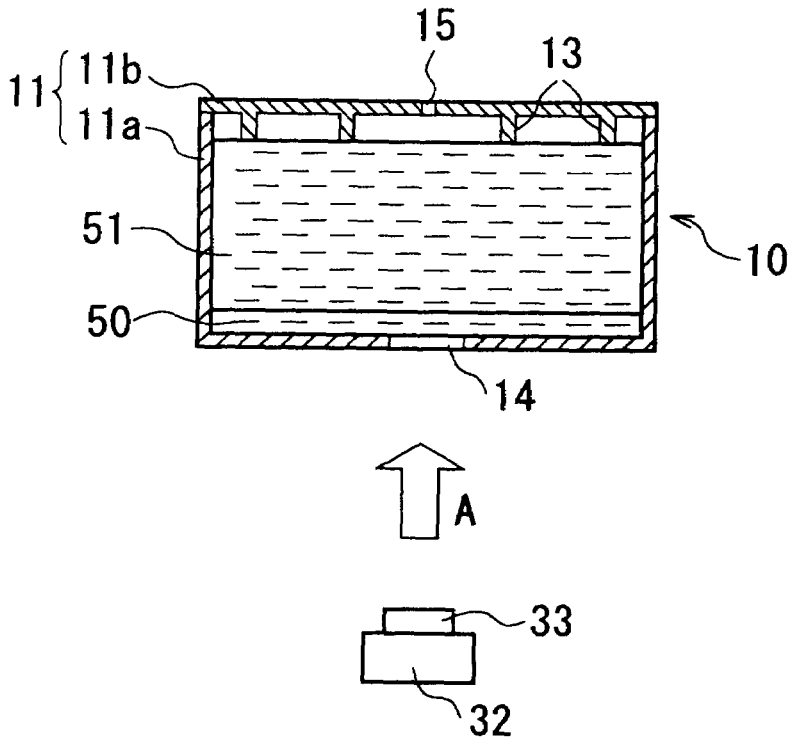
FIG. 9 is a sectional view of the ink container and the ink jet head before connection.
Figure 10:
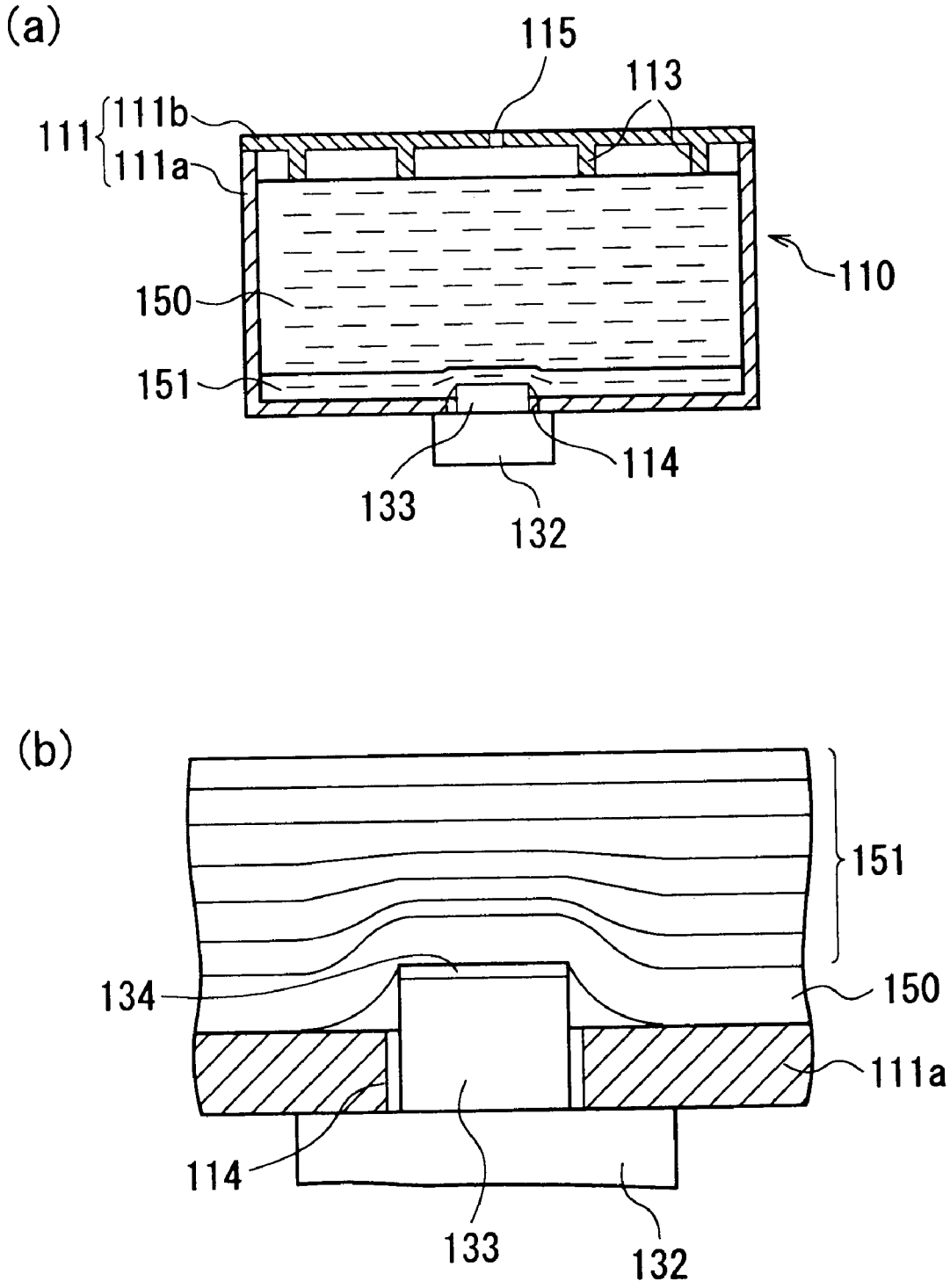
FIG. 10 illustrates connection between the ink container and the ink jet head shown in FIG. 8, wherein (a) is a sectional view, and (b) is an enlarged view of a major part thereof.

Referring to FIGS. 9, 10, the description will be made as to the state in which the ink jet head 132 and holder 131 are connected with the ink container 110. FIGS. 9, 10 are sectional side elevations of the ink container. In FIGS. 9–13, the holder 131 is omitted for better understanding.

In FIG. 9, the ink container 110 is not connected with the ink jet head 132 (holder 131). In FIG. 10, the ink container 110 has been connected with the ink jet head 132 (ink container 110 has been mounted to the holder 131). In this state, the ink receiving tube 133 is contacted to the first ink retaining member 150 in the ink supply port 114, and the ink retained in the first ink retaining member 150 is supplied to a group of the ejection outlet of the ink jet head 132 by way of the ink receiving tube 133 and the ink supply passage.

In the state shown in FIG. 10, the ink receiving tube 133 enters the ink supply port 114 so that ink receiving tube 133 is pressed into the first ink retaining member 150 (approx. 0.5 mm in this embodiment). The first ink retaining member 150 receives a force toward the second ink retaining member 151. Then, the first ink retaining member 150 and the second ink retaining member 151 are compressed in the abutting direction An in FIG. 9.

The state of contact is shown in FIG. 10, (b) in an enlarged scale. Thus, the insertion of the ink receiving tube 133 into the ink supply port 114 is accommodated by deformation of the ink retaining members 150, 151. First, the first ink retaining member 150 in the form of a sheet gradually deforms in accordance with insertion of the ink receiving tube 133, and the second ink retaining member 151 deforms correspondingly to the first ink retaining member 150. As will be understood from FIG. 4, (b), the second ink retaining member 151 is deformed by the first ink retaining member 150 such that deformation is maximum adjacent the central portion where the ink receiving tube 133 is abutted to the first ink retaining member 150 and that compression ratio gradually decreases away from the central portion therearound. Particularly in this embodiment, the direction of lamination of the fibers of the first ink retaining member 150 and the second ink retaining member 151 are substantially parallel with the contact direction An of the ink receiving tube 133, the fibers easily deform in the contact direction A. Therefore, the compression ratio around the ink supply port 114 can be increased without difficulty, and first ink retaining member 150 is compressed as compared with the normal state (FIG. 9 state) in which it is not abutted by the ink receiving tube 133, so that ink retaining force is further enhanced, thus accomplishing more stable ink retention. By smoothing the deformation of the ink retaining members 150, 151 as a result of abutment of the ink receiving tube 133, the space in the ink container 110 not having the ink retaining members 150, 151 can be minimized.

Figure 11:
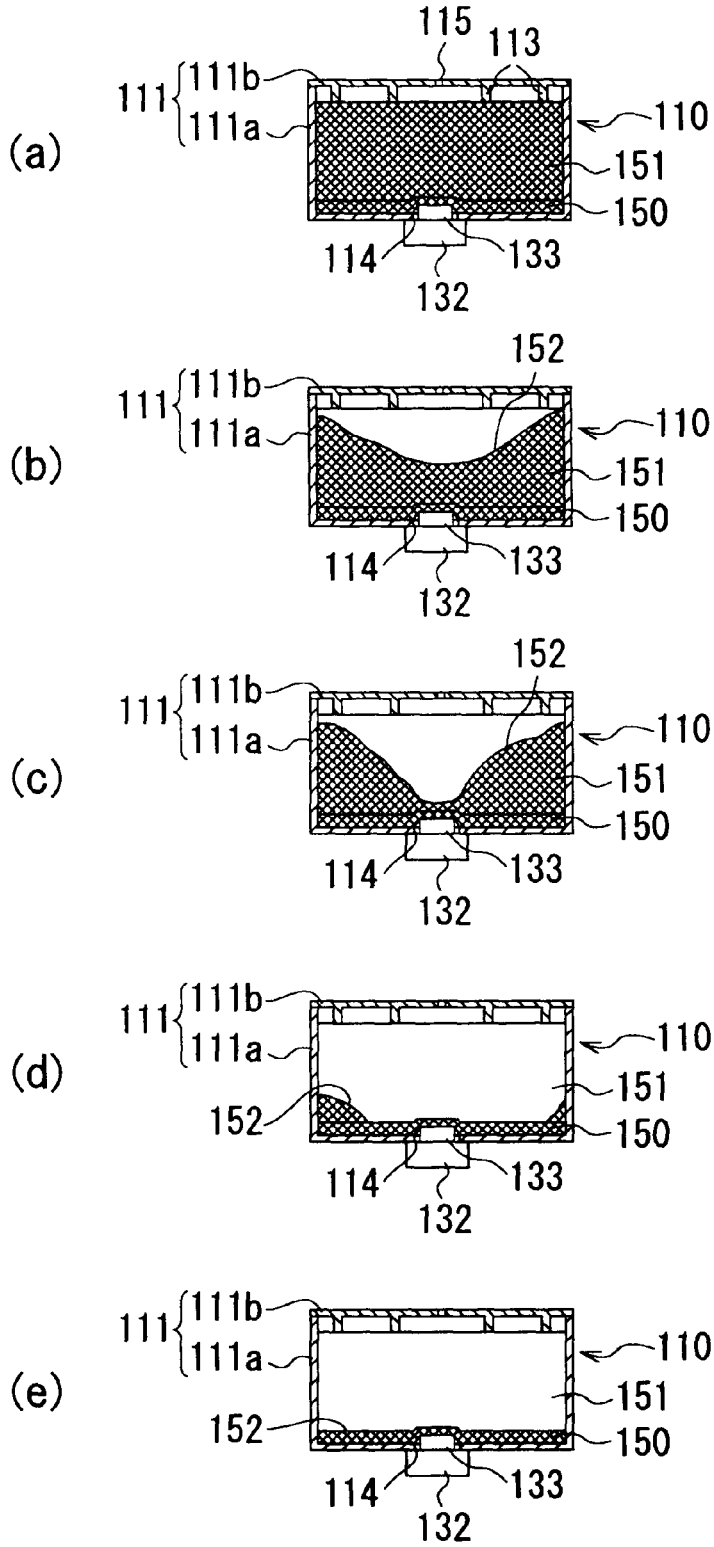
FIG. 11 illustrates ink consumption, wherein (a)–(e) are sectional views of the ink container.

The description will be made as to the movement of the ink in the ink container 110 during the ink supply. FIG. 11 is a sectional view of the ink container 110 wherein it is abutted to the ink jet head 132 and is intended to schematically illustrate the movement of the inner ink in the ink container 110. In FIG. 11, (a)–(e) schematically shows discharge of the ink as indicated by cross-hatching.

In FIG. 11, (a), no ink has been consumed (initial state). The ink retaining members 150, 151 contains a full container capacity of ink. When the ink is supplied from the ink supply port 114 into the ink jet head 132 as shown in FIG. 11, (b), the ink in the first ink retaining member 150 is consumed, and then the ink 152 in the second ink retaining member 151 is consumed, with the result that ink liquid surface 152 lowers, as shown in this Figure. In the state of FIG. 11, (c), the ink is further consumed by the recording operation or the like of the ink jet head 132. In the portion right above the ink supply port 114, from which the ink is most easily discharged, the ink liquid surface 152 has lowered to a neighborhood of the first ink retaining member 150, but in the other portions, the ink sufficiently remains, and therefore, the ink liquid surface 152 is in the second retaining member 151. When the ink is further consumed, the ink in the second ink retaining member 151 gradually moves into the first ink retaining member 150, until almost all of the ink in the second ink retaining member 151 is consumed while the first ink retaining member is substantially fully filled with the ink. The ink moves from the second ink retaining member 151 into the space in the first ink retaining member 150 resulting from consumption of the ink, and therefore, the first ink retaining member 151 can be maintained substantially filled with the ink. Then the state shown in FIG. 11, FIG. 11, (e) is reached wherein substantially no ink is retained in the second ink retaining member 151, but the ink is retained only in the first ink retaining member 150. When the ink is further supplied into the ink jet head 132, the ink is consumed from the first ink retaining member 150 until the ink container 110 is used up.

The description will further be made as to the mechanism of the ink consumption. The ink retained in the second ink retaining member 151 is supplied into the ink receiving tube 133 through the first ink retaining member 150. As described hereinbefore, since the first ink retaining member 150 has an ink retaining force (capillary force) then the second ink retaining member 151, it is effective to gather the ink in the neighborhood of the ink receiving tube 133. Since the neighborhood of the portion of the first ink retaining member 150 where it is press-contacted by the ink receiving tube 133 is compressed, the ink retaining force is further large.

The difference in the ink retaining force in the ink retaining members 150, 151 is far larger than the difference in the ink retaining force resulting from variations in the internal structure of the ink retaining member, so that variation in the inside structure can be ignored. Therefore, into the portion of the first ink retaining member 150 from which the ink is consumed, the ink is quickly supplied from the second ink retaining member 151 having the small ink retaining force. Thus, the ink liquid surface 152 is prevented from lowering at the interface between the ink retaining members 150, 151. After almost all parts of the ink in the second ink retaining member 151 including the parts far away from the ink supply port 114, the ink is further consumed. Then, there exist no ink which flows from the second ink retaining member 151 into the first ink retaining member 150. It is not until this point that portion free of the ink appears in the first ink retaining member 150. The fiber densities of the ink retaining members 150, 151 are so selected that difference in the capillary force between the ink retaining members 150, 151 is large enough to neglect the flow resistance difference resulting from the difference in the length of the ink flow path and/or the variation of the inside structure. By doing so, the use efficiency of the ink of the ink container 110 can be improved.

(Second Embodiment)

Figure 12:
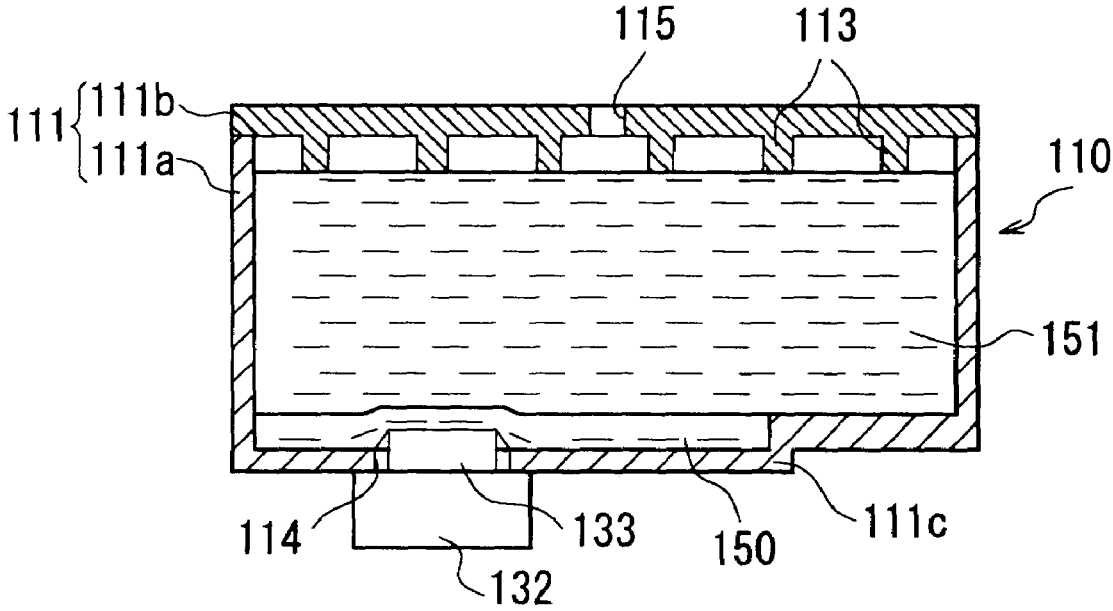
FIG. 12 is a sectional view illustrating the connection between the ink container and the ink jet head according to another embodiment of the present invention.
Figure 13:
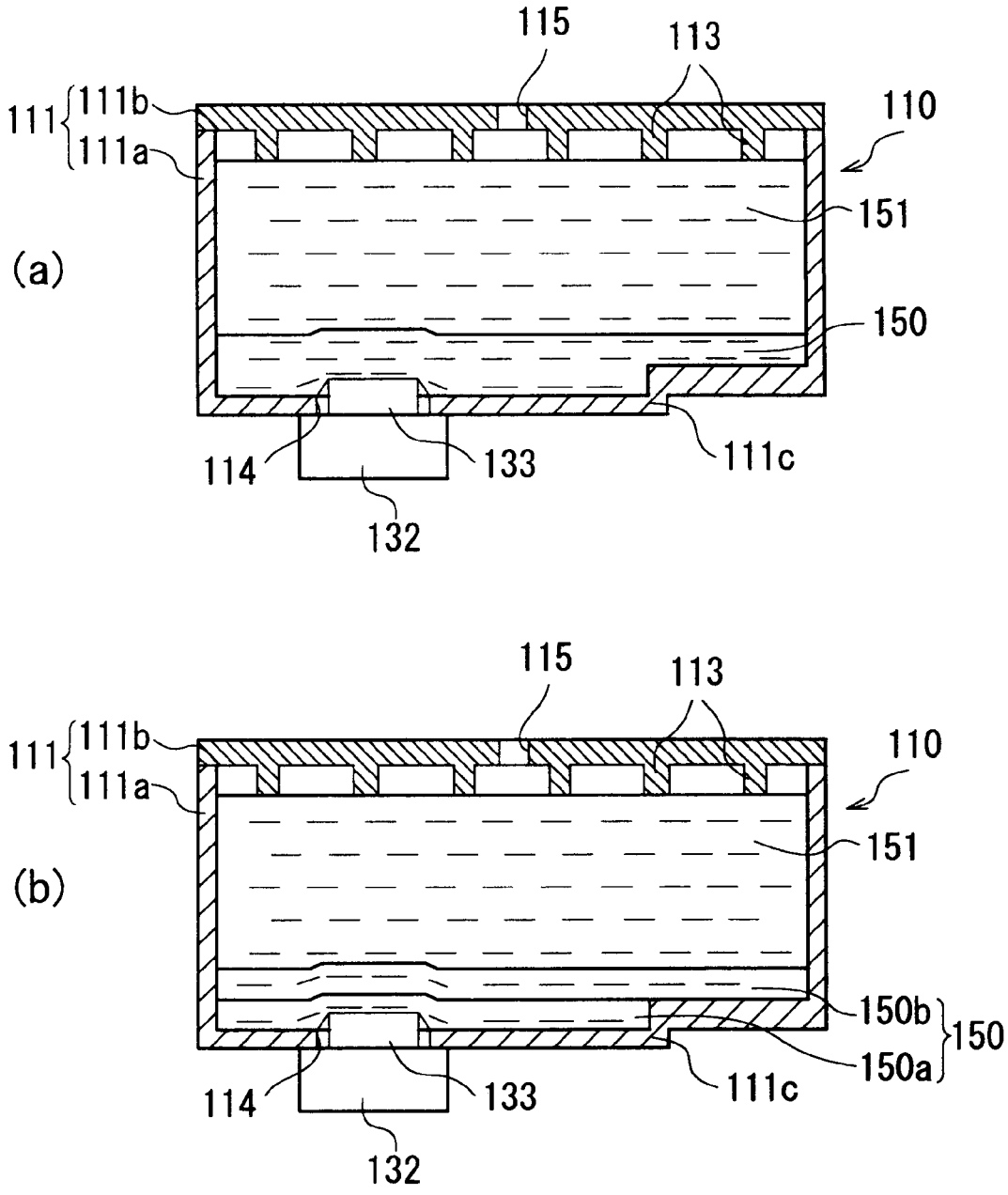
FIG. 13, (a) is a sectional view of a modified example of the ink container and the ink jet head of FIG. 12, and (b) is a sectional view of another modified example.

Referring to FIGS. 12, 13, the description will be made as to a second embodiment. The same reference numerals as with Embodiment 1 is assigned to the elements having the corresponding functions for simplicity.

As shown in FIG. 12, in this embodiment, a portion of the casing 111 of the ink container 110 to which the ink receiving tube 133 is abutted is formed as a raised or projected portion 111*c*, and a first ink retaining member 150 is disposed inside the projected portion 111*c*.

Also in this embodiment, the ink retaining members 150, 151 comprises a laminated webs in which fibers of polyolefin thermoplastic resin material are oriented substantially unidirectionally, and the fibers are compressed in the direction of lamination (fiber aggregate). The first ink retaining member 150 is made of fibers with a fineness of 6.7 dtex (diameter: approx. 54 μm), and the density after compression is approx. 0.05 g/cm$^3$. The first ink retaining member 150 is made of fibers with a fineness of 2.2 dtex (diameter: approx. 18 μm), and the density after compression is approx. 0.15 g/cm$^3$. The longitudinal directions of most of the fibers constituting the fibrous material of the first ink retaining member 150 and the second ink retaining member 151 (axial directions) are substantially perpendicular to the abutting direction of the ink receiving tube 133, and the laminating direction of the web of the fibrous material is substantially parallel with the abutting direction of the ink receiving tube 133.

The surface configuration of the 150 in the cross-section taken along the abutting direction of the ink receiving tube 133 is rectangular (10 mm×23 mm), and the thickness thereof is 1.5 mm. The surface configuration of the second ink retaining member is rectangular (14 mm×23 mm), and the thickness thereof is 12.5 mm.

The casing 111 of the ink container 110 (the main body 111*a* and the cap member) are made of polyolefin resin material similar to the material of the first ink retaining member 150 and second ink retaining member 151.

In this embodiment, the ink container 110 has such a relatively complicated structure as having a projected portion 111*c* at the ink supply port 114 side due to the structure of the main assembly of the recording device. Under such a condition, as shown in FIG. 12, the thickness of the first ink retaining member 150 measured in the direction in which the ink receiving tube 133 is brought into contacted or abutted, is substantially the same as an inner depth of the projected portion 111*c*, and the first ink retaining member 150 is given substantially the same configuration as the inner configuration of the projected portion 111*c* of the casing 111. By doing so, the large second ink retaining member 151 can be a simple rectangular parallelopiped configuration, and therefore, the production property is improved.

In FIG. 13, (a), there is shown an ink container according to a modified example of the present invention, the casing 111 having the configuration which is similar to that shown in FIG. 12. The casing 111 contains a hook-shaped first ink retaining member 150 and a second ink retaining member 151 having a simple rectangular parallelopiped configuration. With such a structure, the upper surface of the first ink retaining member 150 has substantially the same shape as the bottom surface of the second ink retaining member 151, the ink 152 in the second ink retaining member 151 can be used up even when a high speed ink supply is carried out.

FIG. 13, (b) illustrates a further modified example, wherein the first ink retaining member 150 is divided into two parts, one of which is a lower part 150*a* disposed at the ink supply port 114 side and an upper part sandwiched between the lower part 150*a* and the second ink retaining member 151. With this structure, an ink retaining force C1 of the lower part 150*a* of the ink retaining member, an ink retaining force C2 of the upper part of the ink retaining member and an ink retaining force C3 of the second ink retaining member 151, satisfy C1>C2>C3. With this structure, similarly to the structure shown in FIG. 12, the configurations of the ink retaining members (the lower part 150*a*, the upper part 150*b*, the second ink retaining member 151) can be simplified, and similarly to the structure shown in FIG. 13, (a), the ink 152 in the second ink retaining member is prevented from remaining.

In this embodiment, the configuration of the ink container 110 is such that it is projected at the ink supply port 114 side (L-shaped), but configuration of the ink container 110 is not limited to these examples, and a central portion of the ink container 110 may be projected, for example.

In the second embodiment described hereinbefore, the ink retaining members 150, 151 are made of polyolefin fiber, but the structures of the ink retaining members 150, 151 are not limited to the fiber, and the material is not limited to a polyolefin resin material. The densities, the fiber diameters, the directions of the fibers and the like are not limited to the case of the two embodiments. The thicknesses of the ink retaining members 150, 151 measured in the direction in which the ink receiving tube 133 is abutted is not limited to that disclosed with respect to the two embodiments, and may be properly determined in consideration of the kinds of the ink used, the structures of the ink retaining members 150, 151, the flow rates of the ink and the like. In order to obtain a sufficient effects of the present invention, it is desirable that ratio of the thickness of the first ink retaining member 150 measure in the direction of abutment of the ink receiving tube 133 to a maximum inner diameter which is a dimension in a direction perpendicular thereto, is not less than 1:5.

The description will be made as to an ink jet recording apparatus using the recording head cartridge having the above-described structure.

Figure 7:
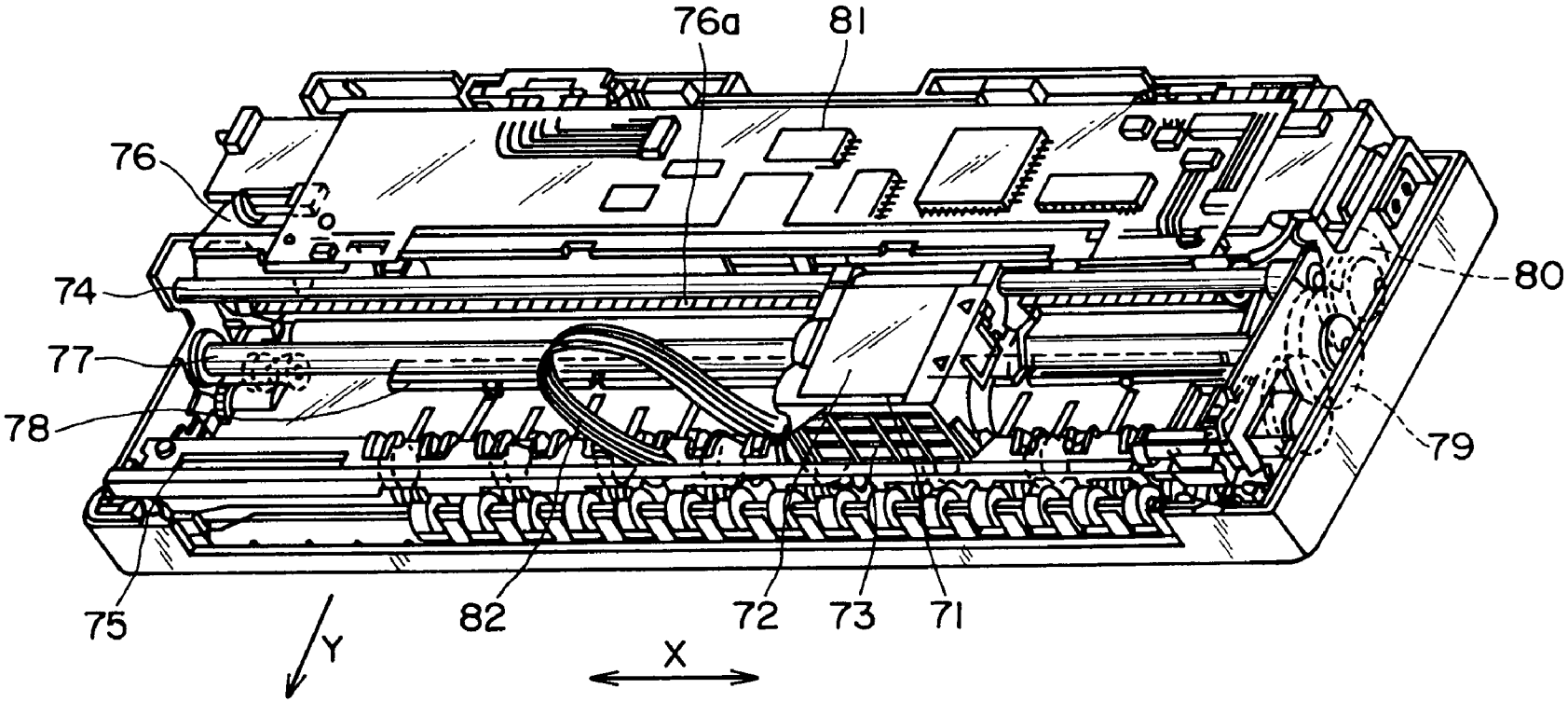
FIG. 7 is a perspective view of an ink jet recording apparatus with which the recording head cartridge of the embodiment of the present invention is usable.

FIG. 7 is a perspective view illustrating a general arrangement of an ink jet recording apparatus carrying the recording head cartridge having the structure described in the foregoing. In the recording device shown in this Figure, a reciprocation movement (main-scanning) of the recording head cartridge 71 in the main scan direction and a feeding of the recording sheet such as a general recording paper, a special paper, OHP film or the like in the sub-scan direction at a predetermined increment, are repeated, and in synchronism with such movements, the ink is selectively ejected from the recording head cartridge 71 and is deposited on the recording sheet, by which letters, signs, images or the like are printed on the recording sheet. Namely, the apparatus is an ordinary serial type recording device.

As shown in FIG. 7, the recording head cartridge 71 with the ink container 72 accommodating the ink for use for image formation, are carried and held on the carriage 73 which is a head holding member. The carriage 73 is guided for movement only in a direction (main scan direction) indicated by an arrow X shown in FIG. 7 by a guiding shaft 74 and a guiding rail 75 which are fixed in the recording device. The carriage 73 is driven by a CR motor 76 through a carriage belt 76*a* to effect a reciprocal scanning motion. In this manner, the guiding shaft 74, the guiding rail 75, CR motor 76, the carriage belt 76*a* constitutes scanning means for reciprocal scanning motion of the carriage 73.

A recording material (unshown) on which the recording is effected by the recording head portion (unshown) of the recording head cartridge 71, is nipped by a LF roller 77 and a pinch roller 78 rotatably mounted in the recording device, and the LF roller 77 is rotated by the LF motor 80 through the LF gear 79, by which as shown in FIG. 7, it is fed in the direction (sub-scan direction) indicated by the arrow Y which is perpendicular to the direction indicated by the arrow X.

In the recording device, a control substrate 81 is mounted. A control circuit (control means) formed on the control substrate 81 generates control signals for controlling the recording head portion, the CR motor 76 and the LF motor 80 to control the operations of them. The recording head 71 and the control substrate 81 are electrically connected with each other by a flexible cable 82 (signal transmitting means), and therefore, the transmission of the control signal between the recording head portion and the control substrate 81 is carried out even during the scanning operation of the recording head cartridge 71 in the direction of the arrow X through the flexible cable 82.

The recording head portion is provided with a plurality of nozzle arrays corresponding to the respective colors, and the inks are ejected through the respective nozzles to effect the printing. In the recording head portion, there are provided a plurality of heat generating resistors (electrothermal transducer elements) as energy generating means for generating energy for ejection to be applied to the ink in the nozzle. A driving signal for driving the recording head portion is transmitted from the control substrate 81 to the recording head portion through the flexible cable 82, the recording head portion and the electrical connecting portion of the flexible cable 82. In response to the driving signal, the ink is ejected from the recording head portion. The method or type of the ink droplet ejection by the recording head portion is not limited to these examples.

The liquid retained in the ink container in this invention is not limited to the above-described black, cyan, magenta and yellow inks, but may be a reaction liquid reactable with the ink or another liquid which is ejected from the recording head.

While the invention has been described with reference to the structures disclosed herein, it is not confined to the details set forth and this application is intended to cover such modifications or changes as may come within the purpose of the improvements or the scope of the following claims.

What is claimed is:

1. An ink container comprising:

a casing having a substantially rectangular shape;

a plurality of ink accommodating portions defined by partition in said casing;

ink supply ports provided, in a bottom side of said casing, for said ink accommodating portions, respectively;

a first engaging portion engageable with a first engaging hole of a holder; and a second engaging portion, provided on a latch lever engageable with a second engaging hole of the holder;

wherein said ink container is detachably mountable to said holder provided with a recording head portion for ejecting ink accommodated in said ink accommodating portion, wherein said first engaging portion, said ink supply ports and said second engaging portion are disposed substantially along a line a respective positions deviated toward one of lone edges of the bottom side, and wherein a plurality of dimple portions are formed around said ink supply ports, respectively, and each of circumferences of said dimple portions opens adjacent to one of the long edges.

2. An ink container according to claim 1, further comprising mounting engageable members at respective positions such as to interpose said plurality of supply ports therebetween, wherein as seen from a top of said ink container, a phantom straight line connecting centers of said mounting engageable members crosses with all of said plurality of supply ports.

3. An ink container according to claim 2, wherein one of said mounting engageable members includes an engaging claw provided on a side surface of said casing, and the other is an engaging claw provided on a lever extending from said casing, and wherein such one of ink supply ports as is closest to said engaging claw provided on said side surface of said casing is deviated toward said partition.

4. An ink container according to claim 1, wherein each of said ink accommodating portion includes an air vent for fluid communication between inside of said ink accommodating portions and an ambience, a first liquid retaining member in the form of a sheet which extends on an inner bottom surface of said casing substantially along an inner configuration of the bottom surface and which is capable of being abutted by an external member through said ink suppl port; a second liquid retaining member closely contacted to said first liquid retaining member to supply the ink therefrom to said first liquid retaining member, wherein said first liquid retaining member has a liquid retaining force which is larger than that of said second liquid retaining member.

5. An ink container according to claim 4, wherein with said ink container mounted to a holder, said first and second liquid retaining members are maintained deformed by an ink receiving tube provided in the holder.

6. An ink container according to claim 4, wherein said first liquid retaining member is a lamination member of fibers, and a laminating direction of the lamination member is substantially the same as an abutting direction of the external member.

7. An ink container according to claim 6, wherein a main axial direction of most of the fibers constituting said laminated fiber, is substantially along a longitudinal direction of the surface of said casing having said liquid supply port.

8. An ink jet recording head comprising a holder for detachably holding an ink container as defined in claim 1 and a recording head portion for receiving the ink from said ink container held in said holder and for ejecting ink droplets.

9. An ink jet recording apparatus, comprising a carriage for detachably carrying said ink jet recording head as defined in claim 8, wherein the ink droplets are ejected from said ink jet recording head onto a recording material to effect recording on the recording material.

10. An ink container according to claim 1, wherein said ink accommodating portions contain yellow ink, magenta ink and cyan ink, respectively.

* * * * *

UNITED STATES PATENT AND TRADEMARK OFFICE

CERTIFICATE OF CORRECTION

PATENT NO. : 7,134,747 B2
APPLICATION NO. : 10/667316
DATED : November 14, 2006
INVENTOR(S) : Hiroki Hayashi et al.

It is certified that error appears in the above-identified patent and that said Letters Patent is hereby corrected as shown below:

COLUMN 1
Line 25, “note” should read --notebook--; and
Line 44, “manipulation” should read --manipulated--.

COLUMN 10
Line 43, “at the of” should read --of--.

COLUMN 11
Line 26, “an-integral” should read --an integral--.

COLUMN 17
Line 15, “a respective” should read --at respective--; and
Line 36, “portion” should read --portions--.

COLUMN 18
Line 4, “suppl” should read --supply--.

Signed and Sealed this

Eighth Day of May, 2007

JON W. DUDAS
*Director of the United States Patent and Trademark Office*